US009275591B2

(12) United States Patent
Bang et al.

(10) Patent No.: US 9,275,591 B2
(45) Date of Patent: Mar. 1, 2016

(54) LIQUID CRYSTAL DISPLAY

(71) Applicant: Samsung Display Co., Ltd., Yongin, Gyeonggi-Do (KR)

(72) Inventors: Nam-Suk Bang, Cheonan-si (KR); Hyun-Sang Cho, Cheonan-si (KR); Joo-Hwan Park, Suwon-si (KR); Jae-Seob Chung, Seoul (KR)

(73) Assignee: SAMSUNG DISPLAY CO., LTD. (KR)

( * ) Notice: Subject to any disclaimer, the term of this patent is extended or adjusted under 35 U.S.C. 154(b) by 0 days.

(21) Appl. No.: 14/182,784

(22) Filed: Feb. 18, 2014

(65) Prior Publication Data

US 2014/0160110 A1 Jun. 12, 2014

Related U.S. Application Data

(62) Division of application No. 12/713,365, filed on Feb. 26, 2010, now Pat. No. 8,692,757.

(30) Foreign Application Priority Data

Mar. 2, 2009 (KR) ..... 10-2009-0017638

(51) Int. Cl.
*G09G 3/36* (2006.01)

(52) U.S. Cl.
CPC ..... *G09G 3/3648* (2013.01); *G09G 3/3677* (2013.01); *G09G 3/3696* (2013.01); *G09G 2330/04* (2013.01)

(58) Field of Classification Search
CPC ..... G09G 3/3677; G09G 2310/0281; G09G 2310/0289; G09G 2310/08; G09G 2320/0223; G09G 2320/0233; G09G 2330/04; G09G 3/3648; G09G 3/3696; G09G 3/2003; G09G 3/3611; G09G 3/3208; G09G 3/36; G09G 3/3607; G09G 5/10; G09G 3/3406; G09G 2320/0646; G09G 2300/08; G09G 2320/0242; G09G 2320/066; G09G 3/3685; G09G 2330/06; G09G 3/3688; G09G 2320/0252; G09G 5/006; G09G 2310/0235; G09G 2310/0286; G09G 2310/061; G09G 2360/16; G09G 2330/021; G09G 2320/0666; G09G 3/3233; G09G 2320/064; G09G 2330/025; G06F 1/28; G06F 1/26; G06F 1/266; G06F 1/3206; G06F 1/324; G06F 1/3265; G06F 3/038; G06F 3/0487
USPC ..... 345/76–102, 211, 690, 204
See application file for complete search history.

(56) References Cited

U.S. PATENT DOCUMENTS 6,300,928 B1 * 10/2001 Kim ..... 345/92
7,038,653 B2 5/2006 Moon (Continued)

FOREIGN PATENT DOCUMENTS

JP 11143432 5/1999
KR 1020040022358 A 3/2004

(Continued)

OTHER PUBLICATIONS

Korean Office Action—KR Application No. 10-2009-0017638 dated Dec. 29, 2014, citing KR2008-0111233A, KR2004-0063788A and KR2004-0024915A.

*Primary Examiner* — Duc Dinh
(74) *Attorney, Agent, or Firm* — Cantor Colburn LLP

(57) ABSTRACT

A liquid crystal display includes a gate driver including stages, and a clock generator which receives a clock generation control signal, generates a clock signal and a clock bar signal based on one or more of the clock generation control signal, a gate-on voltage and a gate-off voltage, and outputs the clock signal and the clock bar signal to the gate driver. The clock generator includes an overcurrent protector unit which intercepts at least one of the clock signal and the clock bar signal when a voltage level of at least one of the gate-on voltage and the gate-off voltage is greater than a reference level.

10 Claims, 15 Drawing Sheets

(56) References Cited

U.S. PATENT DOCUMENTS

| | | | | |
|---|---|---|---|---|
| 7,342,576 | B2 * | 3/2008 | Chegal | 345/204 |
| 8,040,315 | B2 * | 10/2011 | Hirama | 345/100 |
| 8,232,941 | B2 * | 7/2012 | Yeo et al. | 345/87 |
| 2005/0057480 | A1 * | 3/2005 | Liao et al. | 345/98 |
| 2008/0192032 | A1 * | 8/2008 | Park et al. | 345/204 |

FOREIGN PATENT DOCUMENTS

| | | | |
|---|---|---|---|
| KR | 1020040024915 | | 3/2004 |
| KR | 1020040063788 | | 7/2004 |
| KR | 1020070082139 | A | 8/2007 |
| KR | 1020080046934 | A | 5/2008 |
| KR | 1020080111233 | | 12/2008 |

* cited by examiner

LIQUID CRYSTAL DISPLAY

This application is a divisional of U.S. patent application Ser. No. 12/713,365, filed on Feb. 26, 2010, which claims priority to Korean Patent Application No. 10-2009-0017638, filed on Mar. 2, 2009, and all the benefits accruing therefrom under 35 U.S.C. §119, the content of which in its entirety is herein incorporated by reference.

BACKGROUND OF THE INVENTION

1. Field of the Invention

The present invention relates to a display device and, more particularly, to a liquid crystal display device having substantially improved display quality thereof.

2. Description of the Related Art

In a typical liquid crystal display ("LCD"), a gate driver integrated circuit ("IC") is generally packaged using a tape carrier package ("TCP") method or a chip on the glass ("COG") method. Recently, however, alternative methods have been sought, in order to improve manufacturing cost, size and design/performance characteristics of the LCD, for example. As a result, an LCD including a gate driver that generates gate signals using amorphous silicon thin film transistors ("a-Si TFTs") has recently been developed. More specifically, the gate driver including the a-Si TFTs is packaged on a glass substrate, instead of utilizing the gate driver IC in the LCD.

However, there is still a substantially need for further improving a display quality of LCDs including the gate driver using a-Si TFTs.

BRIEF SUMMARY OF THE INVENTION

Exemplary embodiments of the present invention solve the above-mentioned problems, and an exemplary embodiment of the present invention provides a liquid crystal display having a substantially improved display quality.

In an exemplary embodiment, a liquid crystal display includes a gate driver including stages, and a clock generator which receives a clock generation control signal, generates a first clock signal and a second clock signal having a different phase from the first clock signal, a gate-on voltage and/or a gate-off voltage, and outputs the first clock signal and the second clock signal to the gate driver. The clock generator includes an overcurrent protector unit which intercepts at least one of the first clock signal and the second clock signal when a voltage level of at least one of the gate-on voltage and the gate-off voltage is greater than a reference level.

In an alternative exemplary embodiment of the present invention, a liquid crystal display includes a gate driver including stages, and a clock generator which generates a clock signal and a clock bar signal based on a single gate clock signal and outputs the clock signal and the clock bar signal to the gate driver. T clock signal and the clock bar signal are each delayed for a predetermined time from a previous clock signal and a previous clock bar signal, respectively, based on a time delay signal received by the clock generator.

In an alternative exemplary embodiment of the present invention, a liquid crystal display includes a gate driver including stages, and a clock generator which receives first through third clock generation control signals and generates a first clock signal and a second clock signal based on a gate-on voltage and a gate-off voltage and having a different phase from the first clock signal. The clock generator receives the third clock generation control signal at a predetermined time point, the predetermined time point being between a first time point when the gate-on voltage becomes higher than a first reference level and a second time point when the first clock generation control signal is supplied to the clock generator. The clock generator outputs the first clock signal and the second clock signal based on the second clock generation control signal at a third time point when the third clock generation control signal becomes higher than a second reference level.

BRIEF DESCRIPTION OF THE DRAWINGS

The above and other aspects, features and advantages of the present invention will be more readily apparent by describing in further detail exemplary embodiments thereof with reference to the accompanying drawings, in which.

DETAILED DESCRIPTION OF THE INVENTION

Figure 1:
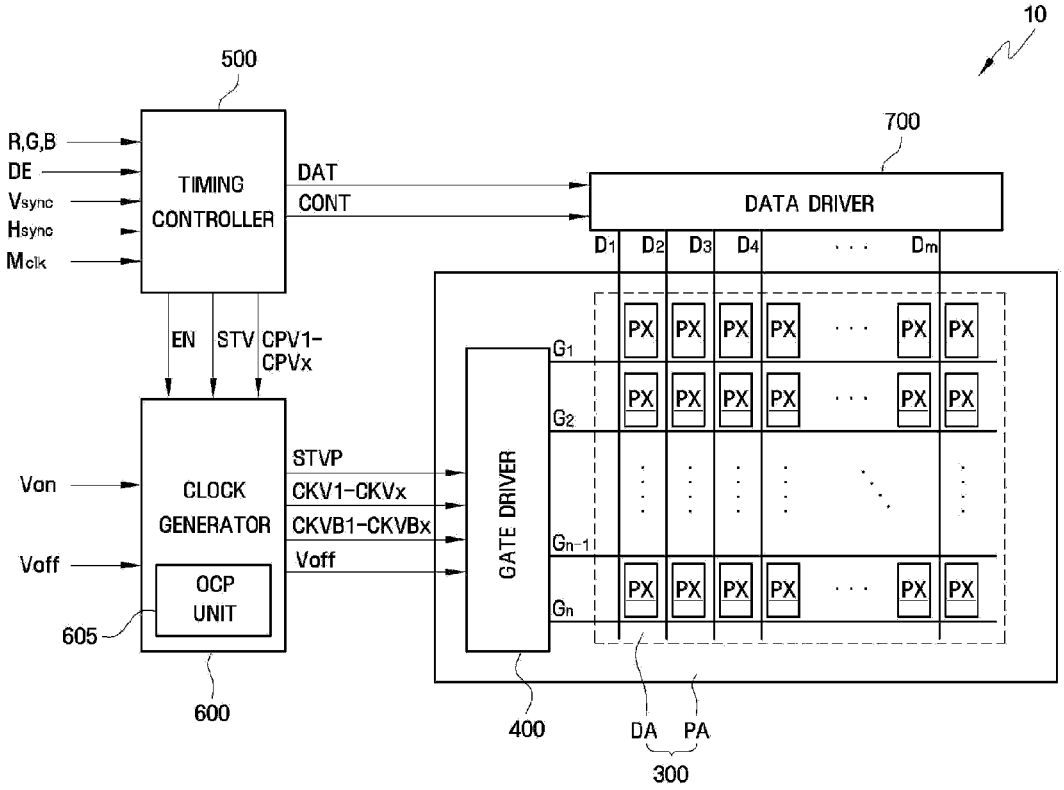
FIG. 1 is a block diagram of an exemplary embodiment of a liquid crystal display according to the present invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, a liquid crystal display according to an exemplary embodiment will be described in further detail with reference to FIGS. 1-5.

Figure 2:
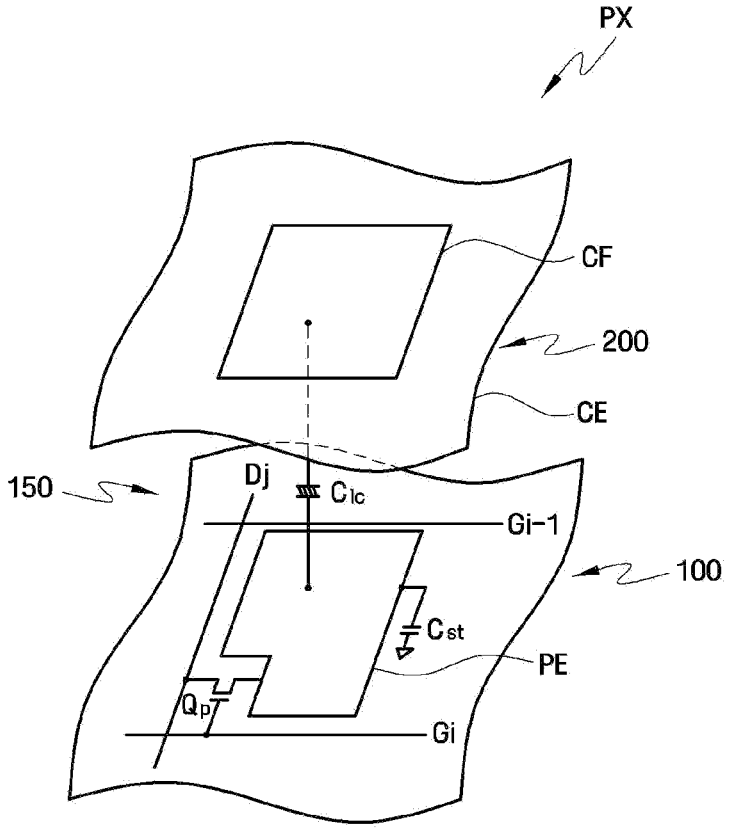
FIG. 2 is an equivalent circuit diagram of a pixel of the liquid crystal display of FIG. 1.
Figure 3:
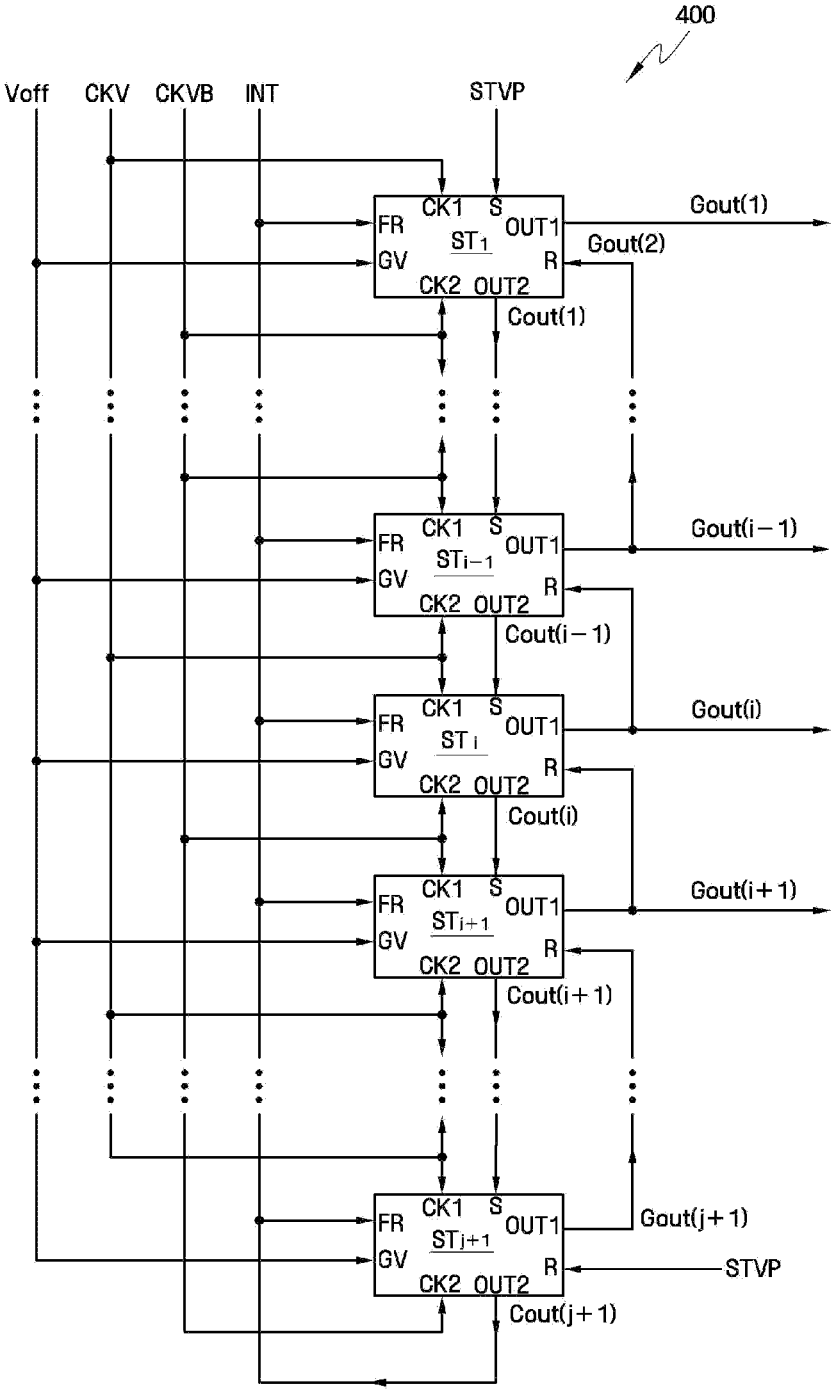
FIG. 3 is a block diagram of an exemplary embodiment of a gate driver of the liquid crystal display of FIG. 1.
Figure 4:
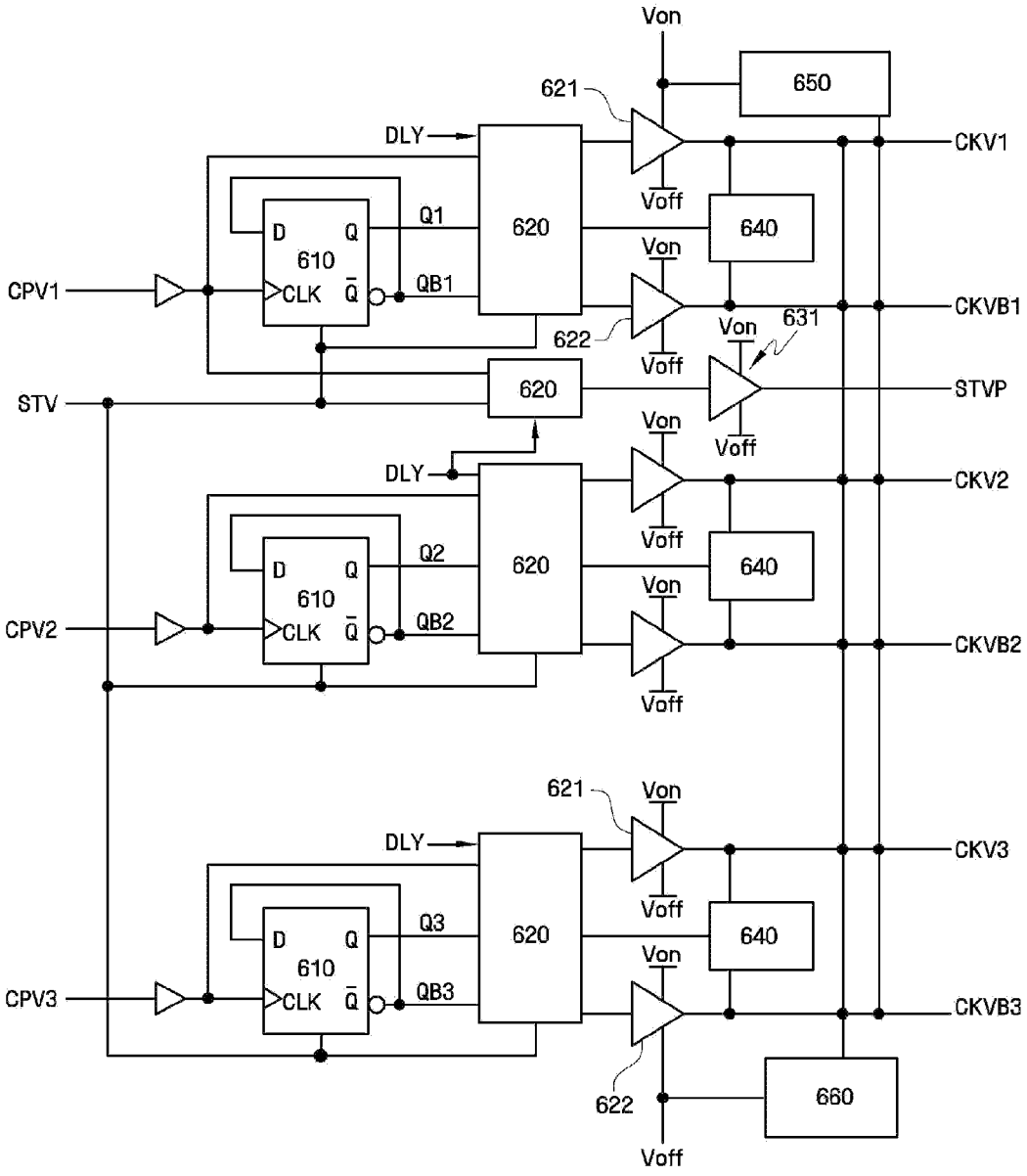
FIG. 4 is a block diagram of an exemplary embodiment of a clock generator of the liquid crystal display of FIG. 1.
Figure 5:
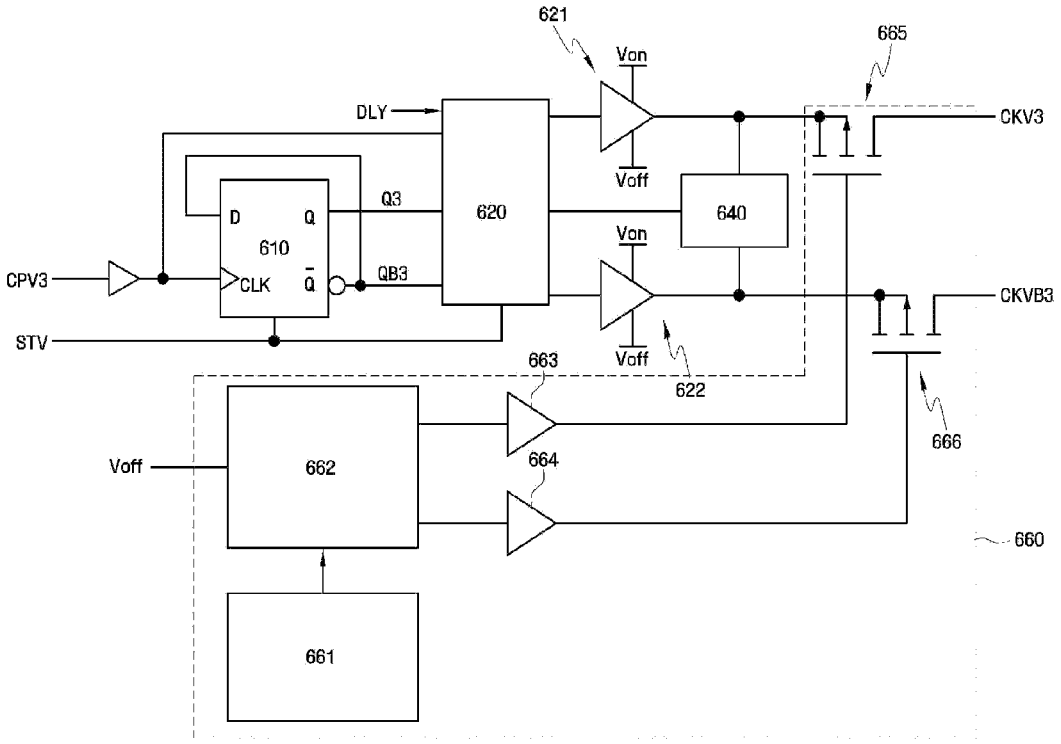
FIG. 5 is a block diagram of an exemplary embodiment of an overcurrent protector ("OCP") part included in the clock generator of FIG. 4.

FIG. 1 is a block diagram of an exemplary embodiment of a liquid crystal display ("LCD") according to the present invention, and FIG. 2 is an equivalent circuit diagram of a pixel of the liquid crystal display of FIG. 1. FIG. 3 is a block diagram of an exemplary embodiment of a gate driver of the LCD of FIG. 1, FIG. 4 is a block diagram of an exemplary embodiment of a clock generator of the LCD of FIG. 1 and FIG. 5 is a block diagram of an exemplary embodiment of an overcurrent protector ("OCP") part of the LCD of FIG. 4.

Referring to FIGS. 1 and 2, a liquid crystal display 10 according to an exemplary embodiment includes a display panel 300, a timing controller 500, a clock generator 600, a gate driver 400 and a data driver 700.

The display panel 300 may be divided into a display area DA, on which an image is displayed, and a non-display area PA, on which the image is not displayed.

The display area DA includes gate lines G1 through Gn, data lines D1 through Dm, a first substrate 100 (FIG. 2) on which pixel switching elements Qp (FIG. 2) and pixel electrodes PE (FIG. 2) are disposed, a second substrate 200 (FIG. 2) on which color filters CF (FIG. 2) and common electrodes CE (FIG. 2) are disposed, and a liquid crystal layer 150 (FIG. 2) interposed between the first substrate 100 (FIG. 2) and the second substrate 200 (FIG. 2). The gate lines G1 through Gn, which are aligned substantially parallel to each another, extend in a first, substantially row, direction, and the data lines D1 through Dm, which are aligned substantially parallel to each another, extend along a second, substantially column, direction crossing the first direction.

As shown in FIG. 2, each pixel PX of the display panel 300 includes one of the common electrodes CE disposed on the second substrate 200, and one of the color filters CF disposed opposite to a corresponding pixel electrode PE on the first substrate 100. In an exemplary embodiment, for example, a given pixel PX, which is connected to an i-th (where, i=1-n) gate line Gi and a j-th (where, j=1-m) data line Dj, includes one of the pixel switching elements Qp connected to signal lines Gi and Dj, e.g., the I-th gate line and the j-th data line, a liquid crystal capacitor Clc and a storage capacitor Cst connected to the switching element Qp. A common voltage may be applied to an end of each of the storage capacitor Cst and the common electrode CE.

Referring again to FIG. 1, the non-display area PA includes an area in which no image is displayed, due to a size of the first substrate 100 (FIG. 2) that is wider than a size of the second substrate 200 (FIG. 2).

The timing controller 500 receives input control signals, such as a horizontal synchronization ("sync") signal Hsync, a vertical sync signal Hsync, a main clock signal Mclk, an input image signal R, G, B and a data enable signal DE, for example, and outputs a data control signal CONT. In an exemplary embodiment, the data control signal CONT is a signal for controlling an operation of the data driver 700, and includes a horizontal start signal (not shown) for starting the operation of the data driver 700 and a load signal (not shown) for instructing output of data voltages, for example.

The data driver 700 receives an image signal DAT and the data control signal CONT from the timing controller 500, and provides an image data voltage corresponding to the image signal DAT to the data lines D1 through Dm. In an exemplary embodiment, the data driver 700 may be an integrated circuit ("IC") that can be connected to the display panel in the form of a tape carrier package ("TCP"). However, alternative exemplary embodiments are not limited thereto, and the data driver 700 may be disposed on the non-display area PA of the display panel 300, for example.

As will be described in greater detail below, the timing controller 500 provides a clock generation control signal to the clock generator 600. The clock generator 600 receives the clock generation control signal, and generates a first clock signal, e.g., a clock signal CKV and a second clock signal, e.g., a clock bar signal CKVB based on the clock generation control signal, a gate-on voltage Von and/or a gate-off voltage Voff to output generated signals to the gate driver 400. Here, the second clock signal has a different phase from the first clock signal. For example, the second clock signal has a inverse phase of the first clock signal.

In an exemplary embodiment, the clock generation control signal includes an output enable signal EN, a first scan start signal STV, and a gate clock signal CPV. In addition, the gate clock signal CPV may include a plurality of signals, e.g., gate clock signals CPV1 through CPVx. In an exemplary embodiment, the clock signal CKV and the clock bar signal CKVB are pulse signals based on the gate-on voltage Von and the gate-off voltage Voff, and the clock signal CKV has a phase opposite to, e.g., inverted from, a phase of the clock bar signal CKVB.

The gate driver 400, which is enabled by a second scan start signal STVP, generates gate signals based on the clock signal CKV, the clock bar signal CKVB and the gate-off voltage Voff, and successively provides the gate signals to the gate lines G1 through Gn. The gate driver 400 will now be described in further detail with reference to FIG. 3.

Referring to FIG. 3, the gate driver 400 includes stages $ST_1$ through $ST_{j+1}$, which are cascade, as shown in FIG. 3. Stages $ST_1$ through $ST_j$ are connected to the gate lines, and output gate signals $Gout_1$, through $Gout_{(j)}$, respectively. The gate-off voltage Voff, the clock signal CKV, the clock bar signal CKVB and an initialization signal INT are inputted to stages $ST_1$ through $ST_{j+1}$. In an exemplary embodiment, the initialization signal NT is provided from the clock generator 600 or, alternatively, from the timing controller 500.

Each of the stages $ST_1$ through $ST_{j+1}$ includes a first clock terminal CK1, a second clock terminal CK2, a set terminal S, a reset terminal R, a supply voltage terminal GV, a frame reset terminal FR, a gate output terminal OUT1 and a carry output terminal OUT2.

Specifically, the carry signal $Cout_{(i-1)}$ of a front-end stage $ST_{i-1}$, is inputted to the set terminal S of the i-th (i∫1) stage $ST_i$ connected to the i-th gate line, and the gate signal $Gout_{(i+1)}$ of a rear-end stage $ST_{i+1}$, is inputted to the reset terminal R thereof. The clock signal CKV and the clock bar signal CKVB are inputted to the first clock terminal CK1 and the second clock terminal CK2, and the gate-off voltage Voff is inputted to the supply voltage terminal GV. The initialization signal NT or, alternatively, the carry signal $Cout_{(j+1)}$ of the last stage $ST_{j+1}$ is inputted to the frame reset terminal FR. The gate output terminal OUT1 outputs a gate signal $Gout_{(i)}$, and the carry output terminal OUT2 outputs a carry signal $Cout_{(i)}$.

As shown in FIG. 3, the second scan start signal STVP is inputted to the first stage $ST_1$, instead of the front-end carry signal. Likewise, the second scan start signal STVP is inputted to a last stage $ST_{j+1}$, instead of a rear-end gate signal.

Referring again to FIG. 1, the clock generator 600 according to an exemplary embodiment includes an overcurrent protector ("OCP") part 605, e.g., an OCP unit 605, that intercepts outputs of clock signals CKV1 through CKVx and clock bar signals CKVB1 through CKVBx when a voltage level of the gate-on voltage or the gate-off voltage is greater than a reference level. The clock generator 600, including the OCP part 605, will now be described in further detail with reference to FIGS. 4 and 5.

Referring to FIG. 4, the clock generator 600 receives a first scan start signal STV and the clock generation control signal, including the gate clock signals CPV1 through CPV3, from the timing controller 500, and generates clock signals CKV1 through CKV3 and clock bar signals CKVB1 through CKVB3 based on the clock generation control signals. Although the exemplary embodiment shown in FIG. 5 includes three pairs of clock signals, e.g., CKV1 through CKV3 and clock bar signals CKVB1 through CKVB3, generated using three gate clock signals CPV1 through CPV3, alternative exemplary embodiments are not limited thereto, and a number of clock generation control signals, including the gate clock signals CPV, clock signals CKV, and clock bar signals CKVB may differ depending upon an intended use of the LCD 10, for example.

In an exemplary embodiment, the clock generator 600 amplifies a received first scan start signal STV using an amplification unit 631 to output a second scan start signal STVP. In an exemplary embodiment, for example, the first scan start signal STV may be a signal which swings, e.g., controls an operation and/or output of, the gate-on voltage Von and the gate-off voltage Voff.

In an exemplary embodiment, the clock generator 600 generates the clock signals CKV1 through CKV3 and the clock bar signals CKVB1 through CKVB3 based on the clock generation control signals, e.g., the gate clock signals CPV1 through CPV3. Moreover, the clock generator 600 according to an exemplary embodiment includes D-type flip-flops 610, clock voltage generation units 620 and charge sharing units 640. However, in alternative exemplary embodiments, the clock generator 600 is not limited to the above-mentioned structure.

The D-type flip-flops 610 output first clock enable signals Q1 through Q3 from first output terminals Q, and output second clock enable signals QB1 through QB3 from second output terminals $\bar{Q}$ ("Q-bar"). More specifically, the clock generation control signals, e.g., the gate clock signals CPV1 through CPV3, are inputted through the clock terminals CLK, and since the second output terminals Q-bar $\bar{Q}$ are connected to input terminals D, the first clock enable signals Q1 through Q3 are outputted through the first output terminals Q, and the second clock enable signals QB1 through QB3, which have phases different from phases of the first clock enable signals Q1 through Q3, are outputted through the second output terminals Q-bar $\bar{Q}$, as shown in FIG. 5

The first clock enable signals Q1 through Q3 and the second clock enable signals QB1 through QB3 are provided to the clock voltage generation units 620.

The clock voltage generation units 620 receive the first clock enable signals Q1 through Q3, and output a high-level voltage, e.g., the gate-on voltage Von, when the first clock enable signals Q1 through Q3 are at high level, while the clock voltage generation units 620 output a low-level voltage, e.g., the gate-off voltage Voff, when the first clock enable signals Q1 through Q3 are at low level. Likewise, the clock voltage generation units 620 receive the second clock enable signals QB1 through QB3, and output a low-level voltage, e.g., the gate-off voltage Voff, when the second clock enable signals QB1 through QB3 are at low level, while the clock voltage generation units 620 output a high-level voltage, e.g., the gate-on voltage Von, when the second clock enable signals QB1 through QB3 are at high level.

Further, the clock voltage generation units 620 generate charge sharing control signals based on the clock generation control signals, and provide the charge sharing control signals to the charge sharing units 640. The charge sharing units 640 receive the charge sharing control signals, and share charges during charging and discharging of capacitors (not shown) connected to respective output terminals of the clock signals CKV1 through CKV3 and the clock bar signals CKVB1 through CKVB3.

As shown in FIG. 4, the D-type flip-flops 610, having received the clock generation control signals, including the gate clock signals CPV1 through CPV3, generate the clock signals CKV1 through CKV3 and the clock bar signals CKVB1 through CKVB3 via the amplification unit, to which the gate-on voltage Von and the gate-off voltage Voff are supplied. Outputting the clock signals CKV1 through CKV3 and the clock bar signals CKVB1 through CKVB3 are controlled by the delay signal DLY.

In an exemplary embodiment, the OCP part 605 of the clock generator 600 includes a first OCP unit 650 and a second OCP unit 660 which intercept the clock signals CKV1 through CKV3 and the clock bar signals CKVB1 through CKVB3 when a voltage level of the gate-on voltage Von or the gate-off voltage Voff is greater than a reference level. As shown in FIG. 4, the first OCP unit 650 and the second OCP unit 660 compare voltage levels of the gate-on voltage Von and/or the gate-off voltage Voff with the reference level, and intercept the clock signals CKV1 through CKV3 and the clock bar signals CKVB1 through CKVB3 based on a result of the comparison.

As also shown in FIG. 4, the first OCP unit 650 and the second OCP unit 660 may be disposed separate form each other, e.g., may be physically separated.

More specifically, the first OCP unit 650 is connected to an input terminal of the gate-on voltage Von, and thereby compares the voltage level of the gate-on voltage Von with the reference level. When the voltage level of the gate-on voltage Von is greater than the reference level, the first OCP unit 650 intercepts the clock signals CKV1 through CKV3 and the clock bar signals CKVB1 through CKVB3. Likewise, the second OCP unit 660 is connected to an input terminal of the gate-off voltage Voff, and thereby compares the voltage level of the gate-off voltage Voff with the reference level. When the voltage level of the gate-off voltage Voff is greater than the reference level, the second OCP unit 660 intercepts the clock signals CKV1 through CKV3 and the clock bar signals CKVB1 through CKVB3.

The second OCP unit 660, which is substantially the same as the first OCP unit 650, will now be described in further detail with reference to FIG. 5. FIG. 5 is a block diagram of an exemplary embodiment of the second OCP unit 660 of the OCP part 605 of the clock generator 600 that generates the clock signal CKV3 and the clock bar signal CKVB3 based on a given clock generation control signal, e.g., based on the gate clock signal CPV3.

As shown in FIG. 5, the second OCP unit 660 includes a reference voltage generation unit 661, an overcurrent judgment unit 662, e.g., an overcurrent determination unit 662, buffer units 663 and 664 and switching elements 665 and 666.

More specifically, the reference voltage generation unit 661, for example, generates and provides the reference level to be compared to the voltage level of the gate-off voltage Voff to the overcurrent determination unit 662, and the overcurrent determination unit 662 determines whether an overcurrent condition has occurred, or is occurring, by comparing the voltage level of the gate-off voltage Voff supplied from the input terminal of the gate-off voltage Voff with the reference level provided from the reference voltage generation unit 661. In an exemplary embodiment, the overcurrent judgment unit 662 may include a comparator (not shown) which compares the voltage level of the gate-off voltage Voff with the reference level.

If it is determined that an overcurrent condition has occurred, or is occurring, in the circuit, the overcurrent determination unit 662 generates an overcurrent generation signal to intercept the clock signal CKV3 and the clock bar signal CKVB3 transmitted from the clock generator 600 to the gate driver 400. More specifically, the clock generator 600 according to an exemplary embodiment may include transmission lines for transmitting the clock signal CKV3 and the clock bar signal CKVB3 to the gate driver 400. In addition, the transmission lines may include a first switching element 665 and a second switching element 666 controlled by the overcurrent generation signals outputted from the overcurrent determination unit 662.

For example, as shown in FIG. 5, the first switching element 665 and the second switching element 666 may include metal oxide semiconductor field effect transistor ("MOSFET") elements, and the overcurrent generation signals generated from the overcurrent determination unit 662 may be applied to gates of the first switching element 665 and the second switching element 666, to control the first switching element 665 and the second switching element 666 to intercept the clock signal CKV3 and the clock bar signal CKVB3 when an overcurrent condition occurs/has occurred.

Thus, the second OCP unit 660 compares the voltage level of the gate-off voltage Voff with the reference level provided from the reference voltage generation unit 661 through the overcurrent determination unit 662, and when the voltage level of the gate-off voltage Voff is greater than the reference level, the second OCP unit 660 generates the overcurrent generation signals. The overcurrent generation signals, generated from the overcurrent determination unit 662, are amplified through buffering units 663 and 664, and are transferred to the first switching element 665 and the second switching element 666. The overcurrent generation signals turn off the first switching element 665 and the second switching element 666, and thus the output of the clock signal CKV3 and the clock bar signal CKVB3 is intercepted, e.g., is effectively prevented from being supplied from the clock generator 600 to the gate driver 400.

Thus, in the liquid crystal display 10 according to an exemplary embodiment, when an overcurrent condition has occurred/occurs in the clock generator 600, the clock generator 600 itself intercepts the output of the clock signals CKV and the clock bar signals CKVB, and thus the liquid crystal display 10 is driven in a substantially more stable manner.

Figure 6:
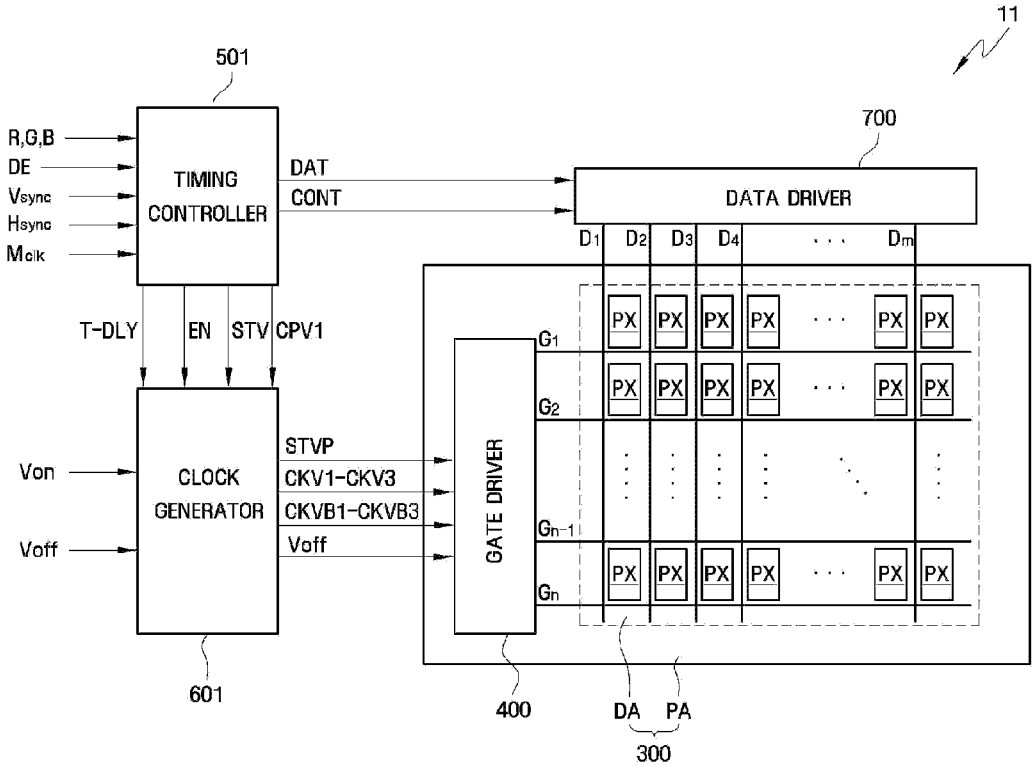
FIG. 6 is a block diagram of an alternative exemplary embodiment of a liquid crystal display according to the present invention.
Figure 7:
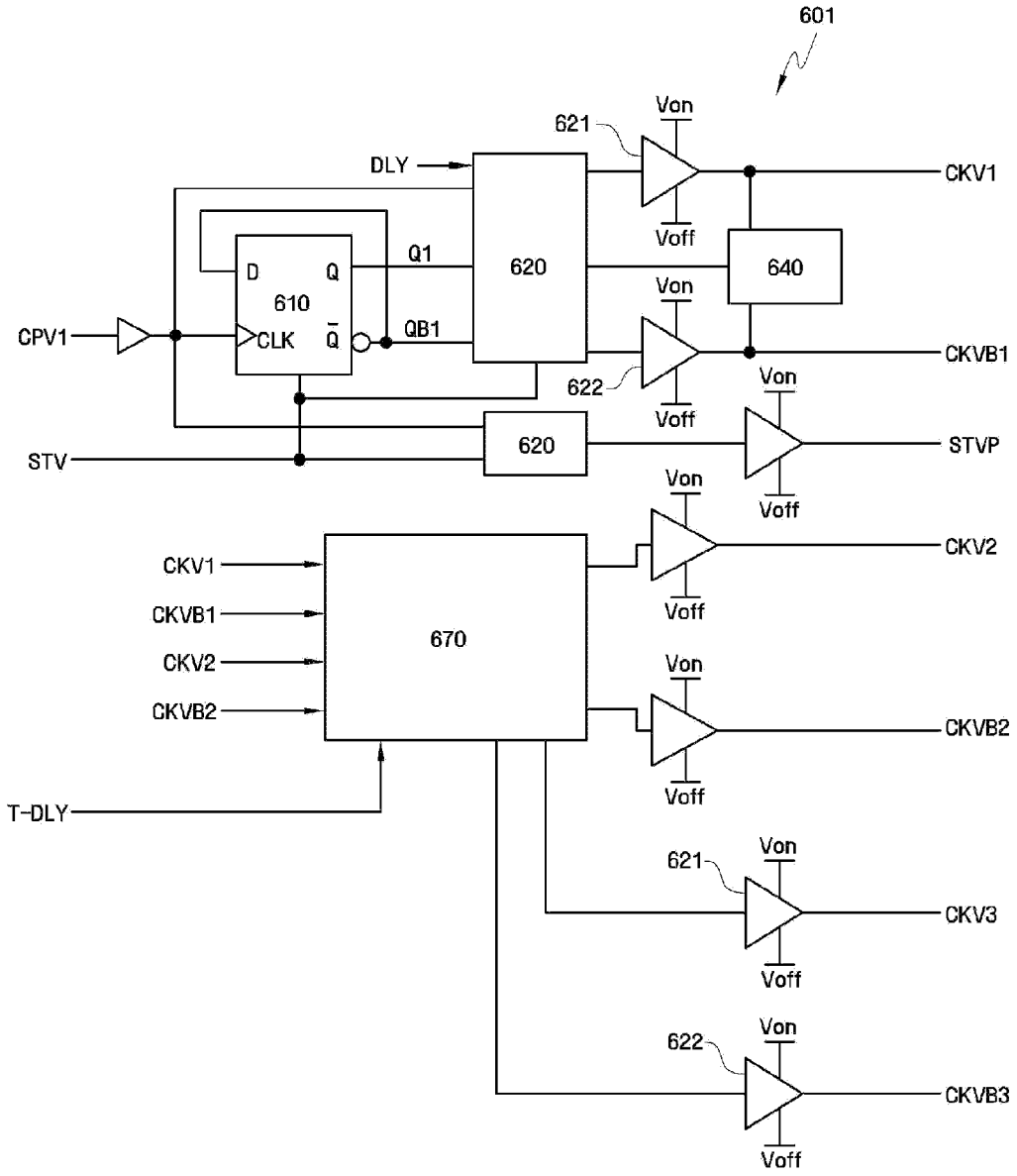
FIG. 7 is a block diagram of an exemplary embodiment of a clock generator of the liquid crystal display of FIG. 6.
Figure 8:
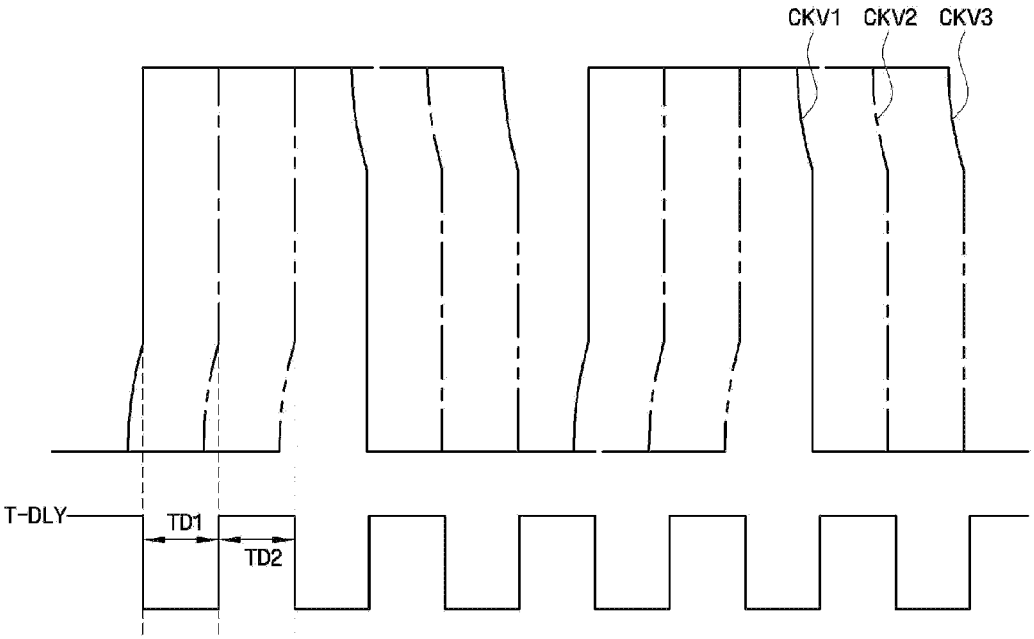
FIG. 8 is a signal timing diagram illustrating relationships between first through third clock signals generated by the clock generator of FIG. 7.
Figure 9:
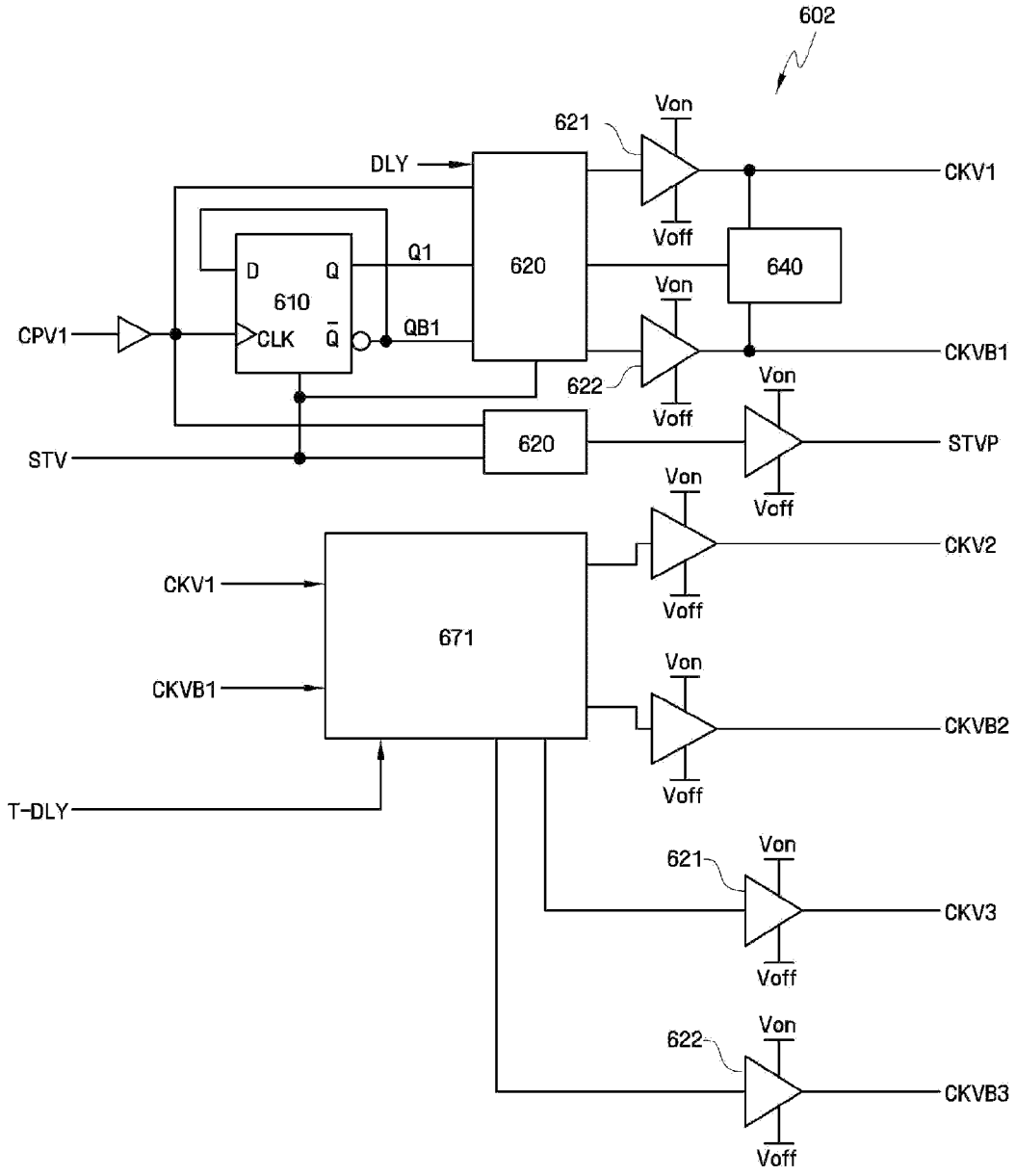
FIG. 9 is a block diagram of an alternative exemplary embodiment of a clock generator of the liquid crystal display of FIG. 6.

A liquid crystal display according to an alternative exemplary embodiment will now be described in further detail with reference to FIGS. 6 through 9. FIG. 6 is a block diagram of an alternative exemplary embodiment of a liquid crystal display according to the present invention, and FIG. 7 is a block diagram of an exemplary embodiment of a clock generator of the LCD of FIG. 6. FIG. 8 is a signal timing diagram illustrating relationships of first through third clock signals generated by a clock generator of the clock generator of FIG. 7, and FIG. 9 is a block diagram of an alternative exemplary embodiment of a clock generator of the LCD of FIG. 6.

As will be described in further detail below, a liquid crystal display 11 according to an alternative exemplary embodiment generates a clock signals and clock bar signals based on one clock generation control signal, e.g., a single one clock generation control signal, by using a time delay signal Hereinafter, the same reference characters denote the same or like components as described in greater detail above, and any repetitive detailed description thereof will be omitted or simplified.

Referring to FIG. 6, the liquid crystal display 11 according to an alternative exemplary embodiment includes a display panel 300, a timing controller 501, a clock generator 601, a gate driver 400 and a data driver 700.

The timing controller 501 of the liquid crystal display 11 provides a clock generation control signal to the clock generator 601. The clock generation control signal may include, for example, an output enable signal EN, a first scan start signal STV, and a gate clock signal CPV1, e.g., a single gate clock signal CPV1, as shown in FIG. 6. In addition, the timing controller 501 according to an exemplary embodiment outputs a time delay signal T-DLY for delaying clock signals CKV1 through CKV3 and clock bar signals CKVB1 through CKVB3 outputted from the clock generator 601 for a predetermined time.

The liquid crystal display 11 generates the clock signals CKV1 through CKV3 and the clock bar signals CKVB1 through CKVB3 by using only one gate clock signal, e.g., the single gate clock signal CPV1, and successively outputs the clock signals CKV1 through CKV3 and the clock bar signals CKVB1 through CKVB3, which have been delayed for a predetermined time from the previous clock signals and clock bar signals, to the gate driver 400.

Although the exemplary embodiment shown in FIG. 6 includes three pairs of clock signals, e.g., CKV1 through CKV3 and clock bar signals CKVB1 through CKVB3, generated using the single gate clock signal CPV1, alternative exemplary embodiments are not limited thereto, wherein more than three pairs of clock signals and clock bar signals may be generated. Further, gate clock signals may be provided from the timing controller 501, clock signals and clock bar signals may therefore be generated for the respective gate clock signals.

The clock generator 601 according to an exemplary embodiment will now be described in further detail with reference to FIG. 7. As shown in FIG. 7, the clock generator 601 receives the single gate clock signal CPV1 and a time delay signal T-DLY, and successively outputs a plurality of clock signals CKV1 through CKV3 and clock bar signals CKVB1 through CKVB3. In an exemplary embodiment, the clock generator 601 includes a D-type flip-flop 610, a clock voltage generation unit 620, a charge sharing unit 640 and a signal delay unit 670.

The D-type flip-flop 610 receives the single gate clock signal CPV1, and outputs first and second clock enable signals Q1 and QB1, respectively, to the clock voltage generation unit 620 through first and second output terminals Q and $^{Q}$ . The clock voltage generation unit 620 receives the first and second clock enable signals Q1 and QB1, respectively, and outputs a first clock signal CKV1 and a first clock bar signal CKVB1.

The signal delay unit 670 receives the first clock signal CKV1 and the first clock bar signal CKVB1, delays the first clock signal CKV1 and the first clock bar signal CKVB1 for a predetermined time, and then outputs a second clock signal CKV2 and a second clock bar signal CKV2. In addition, the second clock signal CKV2 and the second clock bar signal CKVB2 may be amplified through amplifying units 621 and 622 to which the gate-on voltage Von and the gate-off voltage Voff are supplied, as shown in FIG. 7. The signal delay unit 670 receives the second clock signal CKV2 and the second clock bar signal CKVB2 again, delays the second clock signal CKV2 and the second clock bar signal CKVB2 for a predetermined time, and outputs a third clock signal CKV3 and a third clock bar signal CKV3.

Thus, the clock generator 601 receives the single gate clock signal CPV1, and generates the first clock signal CKV1 and the first clock bar signal CKVB1, while the signal delay unit 670 receives the first clock signal CKV1, the first clock bar signal CKVB1 and the time delay signal T-DLY, and outputs the second clock signal CKV2 and the second clock bar signal CKVB2, which have been delayed for a first delay time TD1 (FIG. 8) based on the time delay signal T-DLY. Then, the signal delay unit 670 receives the second clock signal CKV2 and the second clock bar signal CKVB2 again, and outputs the third clock signal CKV3 and the third clock bar signal CKV3, which have been delayed for a second delay time TD2 (FIG. 8) based on the time delay signal T-DLY. In an exemplary embodiment, the first delay time TD1 may be substantially equal to the second delay time TD2. Thus, in an exemplary embodiment, the first through third clock signals CKV1 through CKV3 and clock bar signals CKVB1 through CKVB3 are provided to the gate driver 400 at regular intervals.

As shown in FIG. 8, the time delay signal T-DLY may be a swing signal having predetermined amplitude and frequency. As the time delay signal T-DLY shifts from a high level to a low level, or from the low level to the high level, the third clock signal CKV3 and the third clock bar signal CKVB3 are supplied to the gate driver 400. However, it will be noted that alternative exemplary embodiments are not limited to the signal timing shown in FIG. 8. For example, although the exemplary embodiment shown in FIG. 8 illustrates clock signals and clock bar signals set at an interval of about a half period of the time delay signal T-DLY, the clock signals and clock bar signals may be set at intervals of one period of the time delay signal T-DLY, for example.

Referring now to FIG. 9, the signal delay unit 671 generates the second clock signal CKV2, the second clock bar signal CKVB2, the third clock signal CKV3, and the third clock bar signal CKVB3 based on the first clock signal CKV1 and the first clock bar signal. More specifically, the signal generator 601 receives the single gate clock signal CPV1, and generates the first clock signal CKV1 and the first clock bar signal CKVB1, while the signal delay unit 671 receives the first clock signal CKV1 and the first clock bar signal CKVB1, and outputs the second clock signal CKV2 and the first clock bar signal CKVB2, which have been delayed for the first delay time TD1 by the time delay signal T-DLY. Then, the signal delay unit 671 outputs the third clock signal CKV3 and the third clock bar signal CKVB3, which have been delayed for twice the first delay time TD1 from the first clock signal CKV1 and the first clock bar signal CKVB1. Accordingly, it is not required to re-input the second clock signal CKV2 and the second clock bar signal CKVB2 to the signal delay unit 671 in an exemplary embodiment, thereby substantially simplifying a manufacturing method of the same.

Thus, in the liquid crystal display according to an exemplary embodiment, clock signals and clock bar signals are supplied by using only one gate clock signal and a time delay signal, and thus, a required number of input pins for applying the gate clock signal is substantially reduced. Accordingly, a number of input pins of an integrated circuit including the clock generator, as well as a size of the integrated circuit, are substantially reduced.

Figure 10:
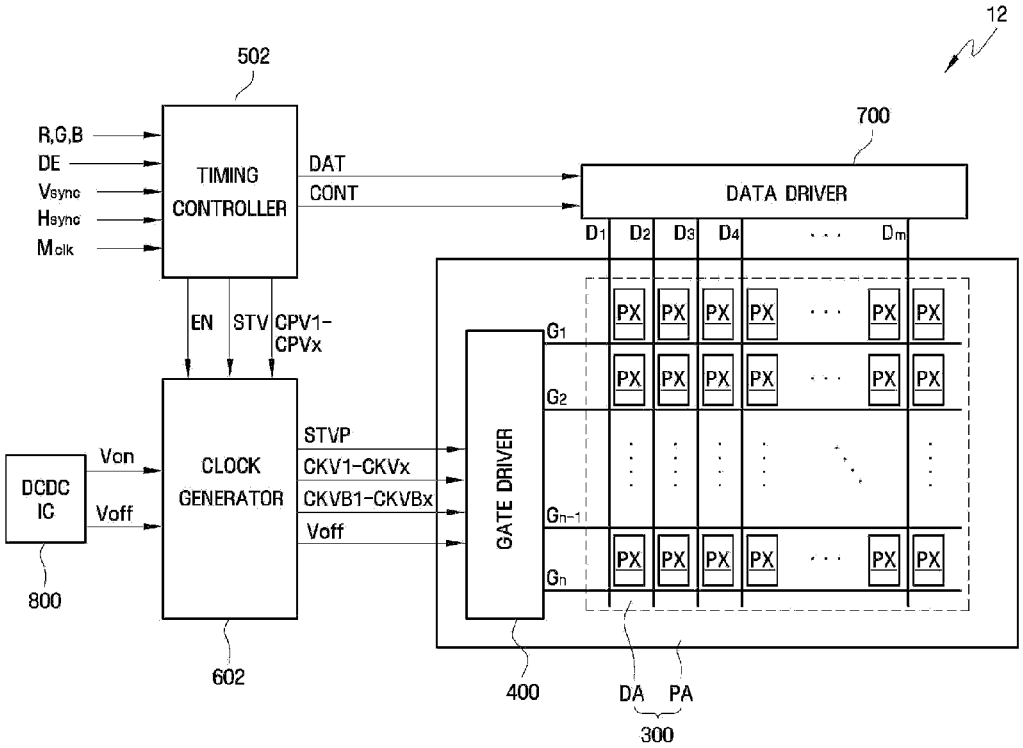
FIG. 10 is a block diagram of another alternative exemplary embodiment of a liquid crystal display according to the present invention.
Figure 11:
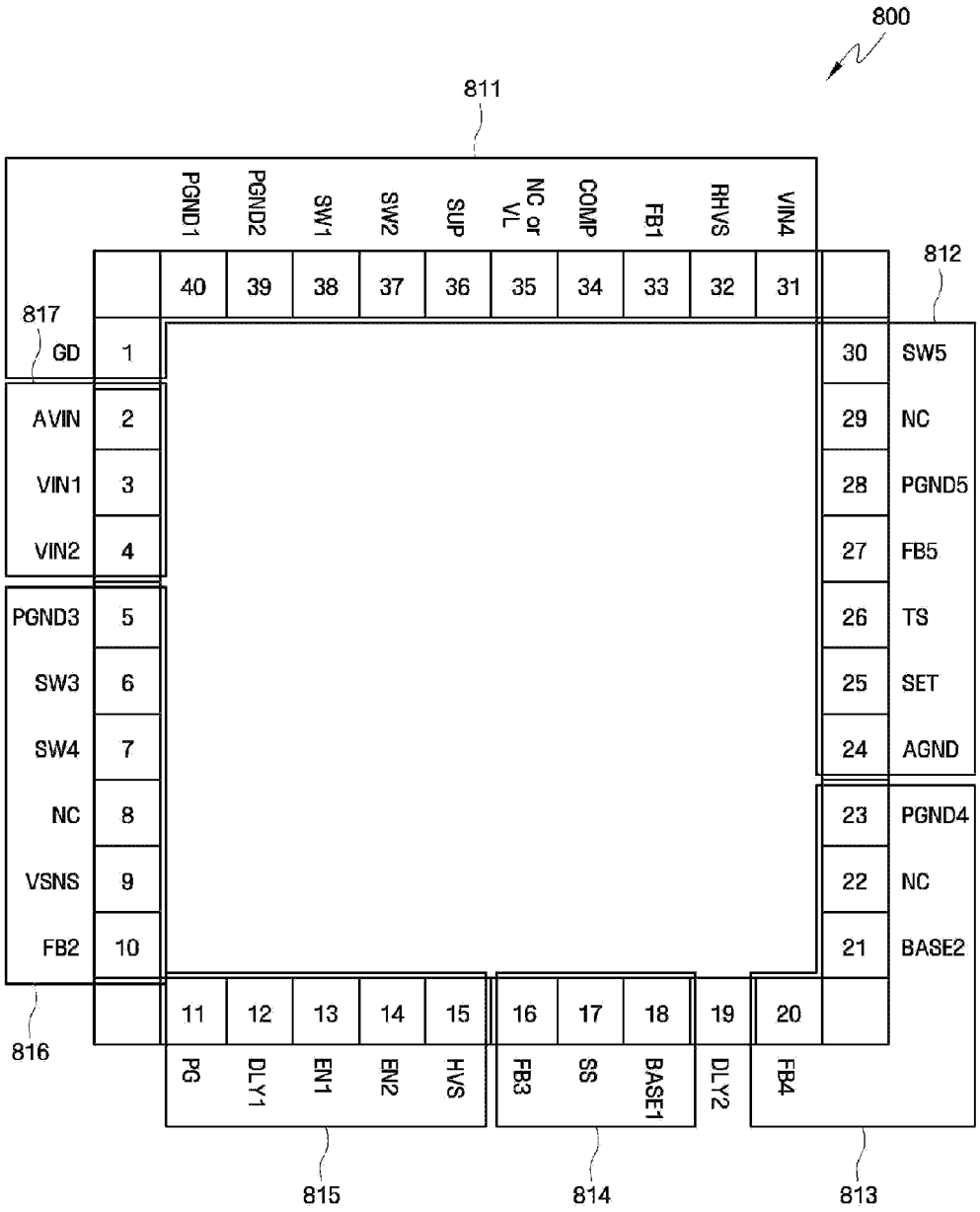
FIG. 11 is a plan view of an exemplary embodiment of a pin arrangement of a voltage generation circuit of the liquid crystal display of FIG. 10.

A liquid crystal display 12 according to another alternative exemplary embodiment of the present invention will now be described in further detail with reference to FIGS. 10 and 11. FIG. 10 is a block diagram of another alternative exemplary embodiment of a liquid crystal display according to the present invention, and FIG. 11 is a plan view illustrating a pin arrangement of a voltage generation circuit DCDC-IC of the LCD of FIG. 10.

As will be described in further detail below, the liquid crystal display 12 according an exemplary embodiment generates driving voltages by using a power supply voltage received from an external source (not shown), and includes a voltage generation circuit integrated into a single integrated circuit. Hereinafter, the same reference characters denote the same or like components as described in greater detail above, and any repetitive detailed description thereof will be omitted or simplified.

Referring now to FIG. 10, the liquid crystal display 12 according to an exemplary embodiment includes a display panel 300, a gate driver 400, a timing controller 502, a data driver 700, a clock generator 602 and a voltage generation circuit 800.

The timing controller 502 outputs an image signal DAT to be displayed on the display panel 300, a data control signal CONT, and clock generation control signals such as an output enable signal EN, a first scan start signal STV, and gate clock signals CPV1 through CPVx. The clock generator 602 receives a gate-on voltage Von and a gate-off voltage Voff, and generates and provides clock signals CKV1 through CKVx and clock bar signals CKVB1 through CKVBx to the gate driver 400. The voltage generation circuit 800 receives a power supply voltage from an external source (not shown), and generates driving voltages for driving the timing controller 502, the clock generator 602 and the data driver 700. In an exemplary embodiment, the voltage generation circuit 800 is disposed in, e.g., is integrated into, a single integrated circuit, and may be disposed physically separately from the clock generator 602.

In an exemplary embodiment, the voltage generation circuit 800 is connected to the clock generator 602, and receives the driving voltages generated from the voltage generation circuit 800. More specifically, the voltage generation circuit 800 generates the gate-on voltage Von and the gate-off voltage Voff by using the power supply voltage supplied from the external source, and provides the gate-on voltage Von and gate-off voltage Voff to the clock generator 602.

As shown in FIG. 11, the voltage generation circuit 800, which is integrated into one IC, as discussed above, includes a boost block 811 including pins VIN4, RHVS, FB1, COMP, NC or VL, SUP, SW2, SW1, PGND2, PGND1 and GD for generating the driving voltages for driving the data driver 700, a gate-off block 812 including pins AGND, SET, TS, FB5, PGND5, NC and SW5 for generating the gate-off voltage Voff, a gate-on block 813 including pins FB4, BASE2, NC and PGND4 for generating the gate-on voltage Von, a reduced voltage generation block 814 including pins FB3, SS and BASE1 for generating a reduced voltage for discharging the gate driver 400, a control block 815 including pins PG, DLY1, EN1, EN2 and HVS for receiving circuit control signals for controlling the voltage generation circuit, a buck block 816 including pins PGND3, SW3, SW4, NC, VSNS and FB2 for generating logic power supply to be provided to the timing controller 502 and peripheral integrated circuits (not shown), and a power supply voltage block 817 including pins AVIN, VIN1 and VIN2 for receiving the power supply voltage from the outside.

By forming the voltage generation circuit 800 according to an exemplary embodiment to include the buck block 816 as a single integrated circuit, a circuit construction is substantially more flexible and a heating characteristic is substantially improved in an exemplary embodiment.

Figure 12:
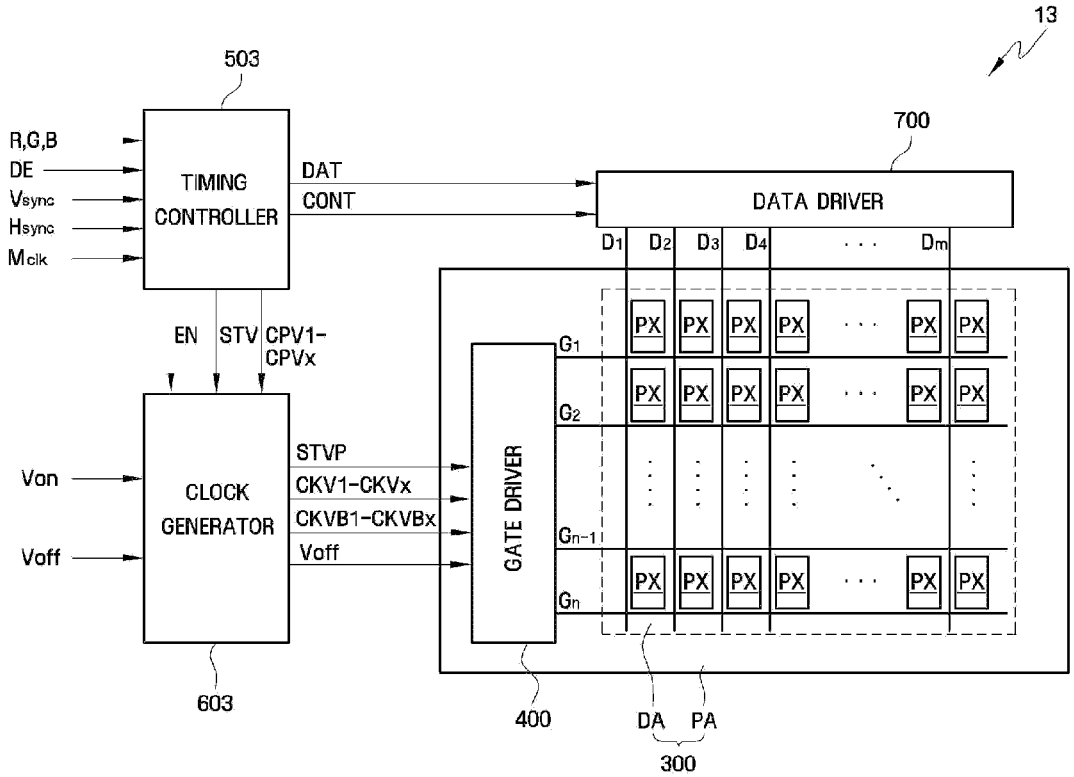
FIG. 12 is a block diagram of yet another alternative exemplary embodiment of a liquid crystal display according to the present invention.
Figure 13:
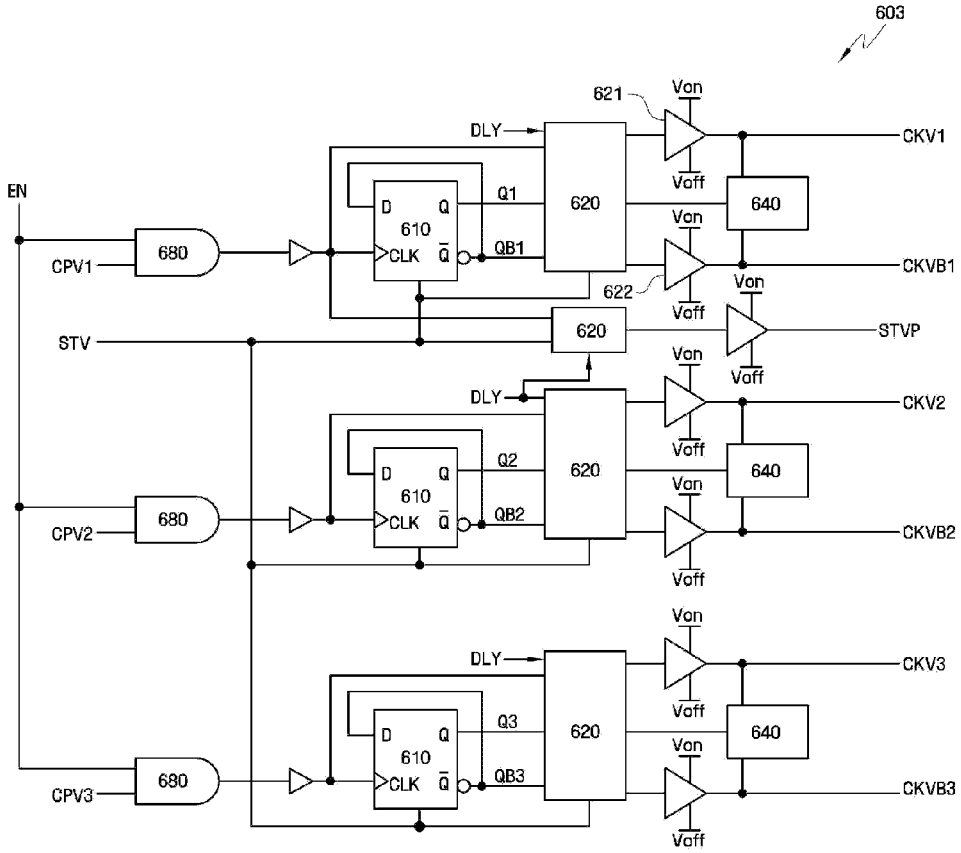
FIG. 13 is a block diagram of an exemplary embodiment of a clock generator of the liquid crystal display of FIG. 12.
Figure 14:
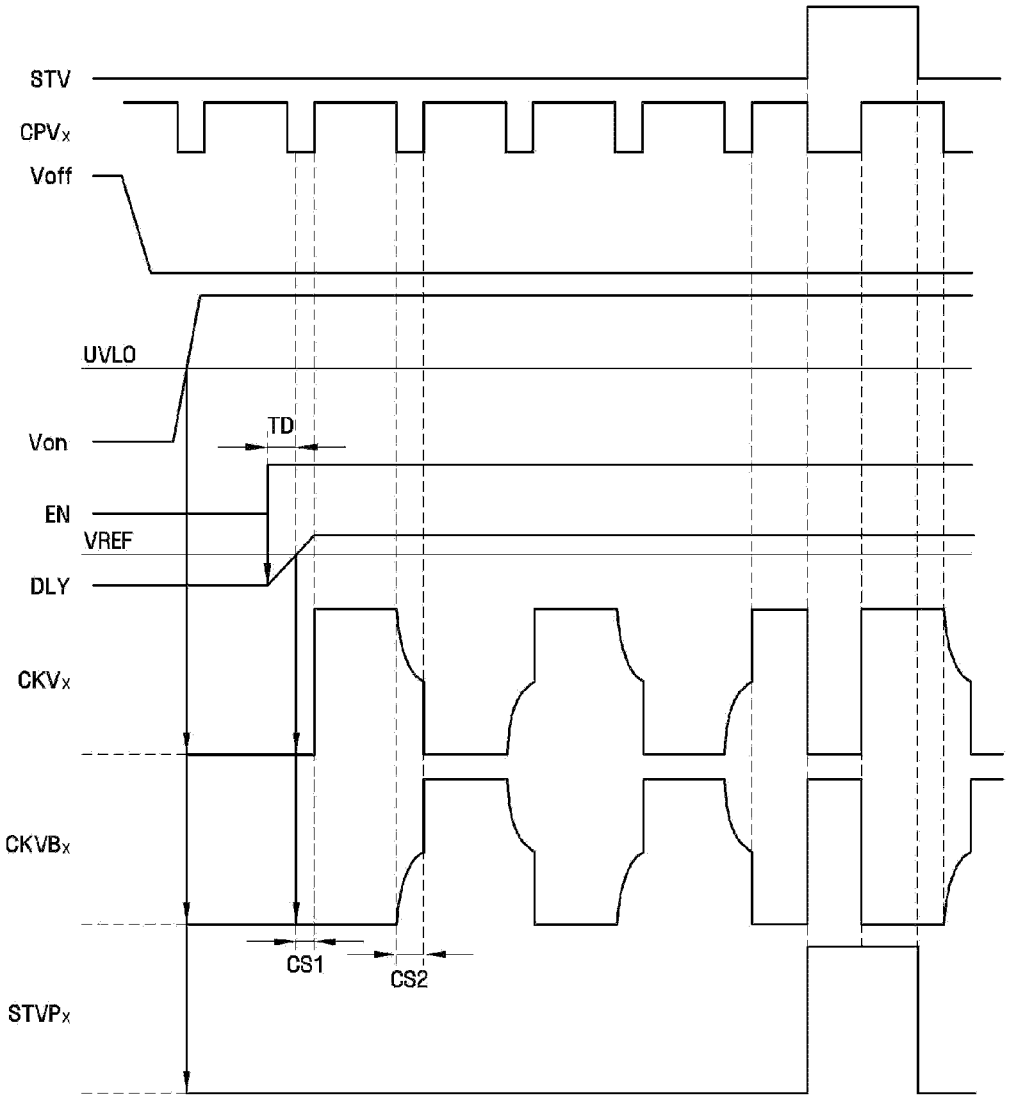
FIG. 14 is a signal timing diagram illustrating signals of an exemplary embodiment of a clock generator of the liquid crystal display of FIG. 12.
Figure 15:
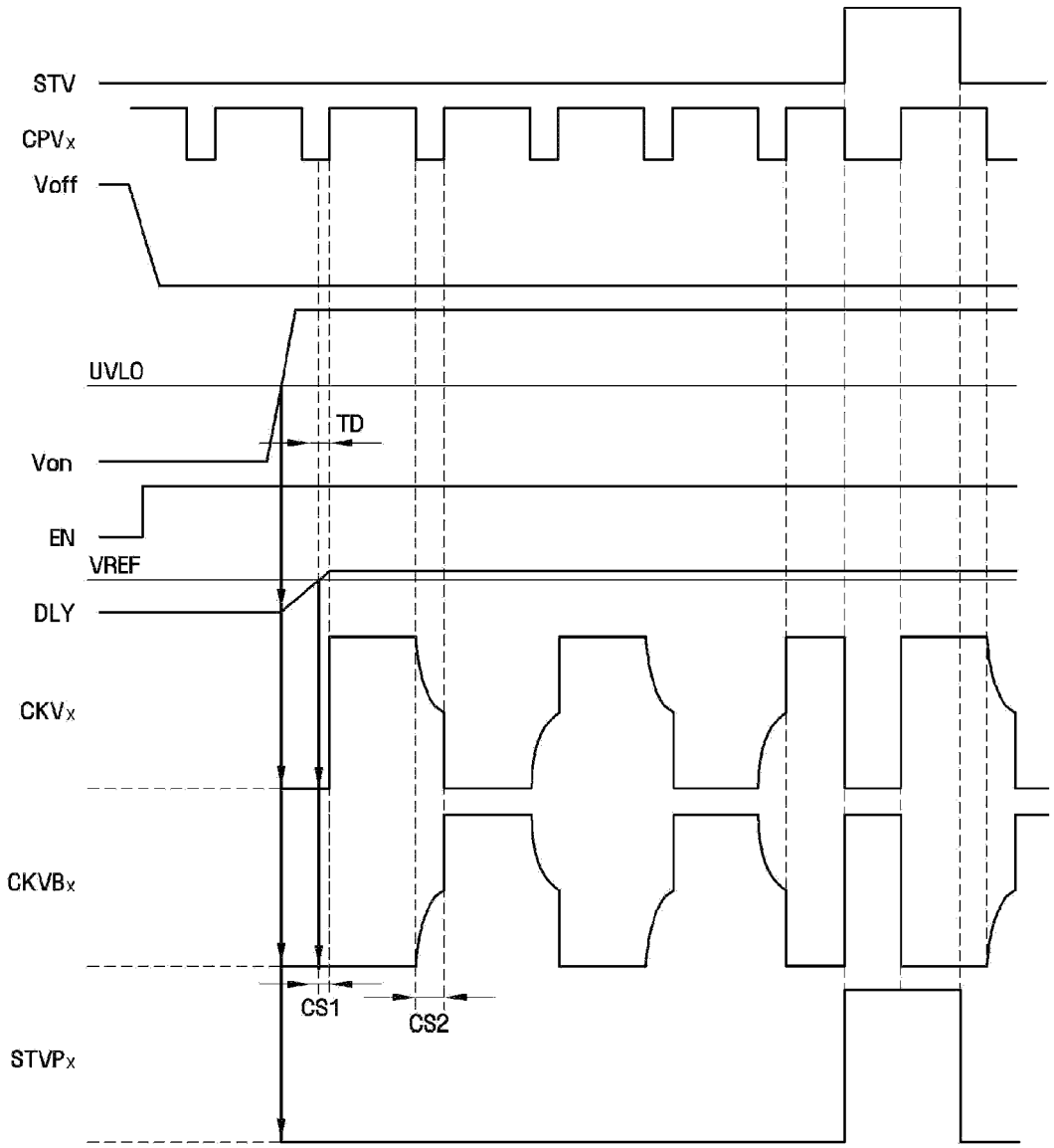
FIG. 15 is a signal timing diagram illustrating signals of an alternative exemplary embodiment of a clock generator of the liquid crystal display of FIG. 12.

A liquid crystal display 13 according to still another alternative exemplary embodiment of the present invention will now be described in further detail with reference to FIGS. 12-15. FIG. 12 is a block diagram of another alternative exemplary embodiment of a liquid crystal display according to the present invention, and FIG. 13 is a block diagram of an exemplary embodiment of a clock generator of the LCD of FIG. 12. FIG. 14 is a signal timing diagram illustrating signals of an exemplary embodiment of a clock generator of the LCD of FIG. 12, and FIG. 15 is a signal timing diagram illustrating signals of an alternative exemplary embodiment of a clock generator of the LCD of FIG. 12.

The liquid crystal display 13 according to an exemplary embodiment generates clock signals and clock bar signals based on input relations between a gate-on voltage and first through third clock generation control signals Hereinafter, the same reference characters denote the same or like components as described in greater detail above, and any repetitive detailed description thereof will be omitted or simplified.

Referring now to FIG. 12, the liquid crystal display 13 according to an exemplary embodiment includes a clock generator 603 that receives first through third clock generation control signals, e.g., an output enable signal EN, a gate clock signal CPV (including a plurality of gate clock signals CPV1-CPVx) and a delay signal DLY, respectively, and generates clock signals CPV1 through CPVx and clock bar signals CPVB1 through CPVBx by using the gate-on voltage Von and the gate-off voltage Voff. More specifically, the clock generator 603 according to an exemplary embodiment receives the delay signal DLY at a predetermined time point, e.g., a later time point between a first time point when the gate-on voltage Von becomes higher than a first reference level and a second time point when the first clock generation control signal EN is applied, and outputs the clock signal CKV and the clock bar signal CKVB based on the gate clock signal CPV at a third time point when the delay signal DLY becomes higher than a second reference level.

Referring now to FIG. 13, the clock generator 603 receives the output enable signal EN, and provides the gate clock signal CPV and the output enable signal EN to a D-type flip-flop 610 through an AND gate 680. As shown in FIG. 13, gate clock signals CPV are applied to a plurality of the AND gates 680, and the output enable signal EN may also be applied to each of the AND gates 680. Thus, the gate clock signal CPV and the output enable signal EN are applied from the clock generator 603 to the AND gate 680, and, accordingly, when the output enable signal EN goes to a high level, the gate clock signal CPV passes through a buffer unit, and the clock signal CKV and the clock bar signal CKVB for driving the gate driver 400 are thereby outputted.

Referring to FIG. 14, relationship between signals of the clock generator 603 according to an exemplary embodiment will now be described in further detail. As shown in FIG. 14, when a rising of the gate-on voltage Von and a falling of the gate-off voltage Voff are completed and voltage thereof reach stabilized states after the gate-on voltage Von exceeds a first reference level UVLO, the output enable signal EN is applied as a normal voltage state signal. Thus, when the first time point when the gate-on voltage Von becomes higher than the first reference level UVLO precedes the second time point when the output enable signal EN is applied, the third clock generation control signal, e.g. the delay signal DLY, may be applied at the second time point when the output enable signal EN is applied. When the delay signal DLY is applied, a length of the time delay TD can be adjusted in accordance with a value of a capacitor (not shown) connected to a time delay signal pin.

Thus, a voltage generation circuit (not shown) that receives the power supply voltage from an external source (not shown) and generates the gate-on voltage Von and the gate-off voltage may be further included, and when the gate-on voltage Von and the gate-off voltage Voff reach the stabilized state, the voltage generation circuit outputs the normal voltage state signal to the clock generator 603.

Thereafter, based on the voltage level of the second clock generation control signal, e.g. the gate clock signal CPV, (e.g., whether the second clock generation control signal is at a high level or a low level) at the third time point when the delay signal DLY becomes higher than the second reference level Vref, it is determined whether to output the clock signal CKV and the clock bar signal CKVB. As shown in FIG. 14, when the gate clock signal CPV transitions to a low level at the third time point when the delay signal DLY becomes higher than a second reference level Vref, the clock signal CKV and the clock bar signal CKVB are not outputted. Instead, charges are shared therebetween until the gate clock signal CPV is shifted to, e.g., transitions to, a high level (e.g., for period CS1 in FIG. 14). In contrast, when the gate clock signal CPV transitions to a high level at the third time point when the delay signal DLY becomes higher than the second reference level Vref, the clock signal CKV and the clock bar signal CKVB are normally outputted. Here, for the period CS2, charges can be shared therebetween until the gate clock signal CPV is reshifted to, e.g., transitions to, a high level.

Referring now to FIG. 15, another relationship between signals of the clock generator 603 according to an alternative exemplary embodiment will now be described in further detail. Unlike in the exemplary embodiment shown in FIG. 14, the clock generator 603 according to an alternative exemplary embodiment receives the output enable signal EN as the normal voltage state signal which is optionally generated. When the output enable signal EN is first applied, e.g., when the second time point when the output enable signal EN is applied precedes the first time point when the gate-on voltage Von exceeds the first reference level UVLO, the delay signal DLY is applied when the first time point when the gate-on voltage Von becomes higher than the first reference level UVLO. Then, as described in greater detail above, based on the voltage level (e.g. whether it is at a high level or a low level) of the gate clock signal CPV at the third time point when the delay signal DLY becomes higher than the second reference level Vref, it is determined whether to output the clock signal CKV and the clock bar signal CKVB.

As described herein, in a liquid crystal display according an exemplary embodiment, a signal generation process for generating a clock signal and a clock bar signal is substantially simplified.

The present invention should not be construed as being limited to the exemplary embodiments set forth herein. Rather, these exemplary embodiments are provided so that this disclosure will be thorough and complete and will fully convey the concept of the present invention to those skilled in the art.

Although the present invention has been particularly shown and described with reference to exemplary embodiments thereof, it will be understood by those of ordinary skill in the art that various changes, modifications, additions and substitutions in form and detail may be made therein without departing from the scope or spirit of the present invention as defined by the following claims.

What is claimed is:

1. A liquid crystal display comprising:

a gate driver including stages; and a clock generator which receives a single gate clock signal and generates a clock signal and a clock bar signal based on the single gate clock signal and outputs the clock signal and the clock bar signal to the gate driver, wherein the clock signal and the clock bar signal are each delayed for a same predetermined time from a previous clock signal and a previous clock bar signal, respectively, based on a time delay signal received by the clock generator, and the clock signal and the clock bar signal include first through third clock signals and first through third clock bar signals, respectively, and the first through third clock signals and the first through third clock bar signals are each successively outputted, and the clock generator receives the single gate clock signal and generates the first clock signal and the first clock bar signal, and successively thereafter generates the second clock signal and the second clock bar signal and the third clock signal and the third clock bar signal based on the first clock signal, the first clock bar signal and the time delay signal.

2. The liquid crystal display of claim 1, wherein the second clock signal and the second clock bar signal are delayed for a first period of time from the first clock signal and the second clock bar signal based on the time delay signal, and the third clock signal and the third clock bar signal are delayed for a second period of time, the second period of time being twice as long as the first period of time, from the first clock signal and the first clock bar signal based on the time delay signal.

3. A liquid crystal display comprising:

a gate driver including stages; and a clock generator which receives a single gate clock signal and generates a clock signal and a clock bar signal based on the single gate clock signal and outputs the clock signal and the clock bar signal to the gate driver, wherein the clock signal and the clock bar signal are each delayed for a predetermined time from a previous clock signal and a previous clock bar signal, respectively, based on a time delay signal received by the clock generator, wherein the clock signal and the clock bar signal include first through third clock signals and first through third clock bar signals, respectively, the first through third clock signals are successively outputted, the first through third clock bar signals are successively outputted, the clock generator receives the single gate clock signal and generates the first clock signal and the first clock bar signal, the clock generator generates the second clock signal and the second clock bar signal delayed from the first clock signal and the first clock bar signal for a first period of time based on the time delay signal, and the clock generator generates the third clock signal and the third clock bar signal delayed the second clock signal and the second clock bar signal for a second period of time based on the time delay signal.

4. The liquid crystal display of claim 3, wherein the first period of time is equal to the second period of time.

5. A liquid crystal display comprising:

a gate driver including stages; and a clock generator which receives first through third clock generation control signals, and generates a first clock signal and a second clock signal based on a gate-on voltage and a gate-off voltage and the second clock signal having a different phase from the first clock signal, wherein the clock generator receives the third clock generation control signal at a predetermined time point, the predetermined time point being between a first time point when the gate-on voltage becomes higher than a first reference level and a second time point when the first clock generation control signal is supplied to the clock generator, and the clock generator outputs the first clock signal and the second clock signal based on the second clock generation control signal at a third time point when the third clock generation control signal becomes higher than a second reference level.

6. The liquid crystal display of claim 5, wherein when the second clock generation control signal transitions to a first level at the third time point, the first clock signal and the second clock signal are normally outputted, and when the second clock generation control signal transitions to a second level, different from the first level, at the third time point, the first clock signal and the second clock signal are not outputted and charge sharing is performed until the second clock generation control signal transitions to the first level.

7. The liquid crystal display of claim 5, further comprising a voltage generation circuit which receives a power supply voltage and generates the gate-on voltage and the gate-off voltage, wherein the voltage generation circuit provides a normal voltage state signal to the clock generator for reporting a normal output of the gate-on voltage and the gate-off voltage.

8. The liquid crystal display of claim 7, wherein the clock generator receives the normal voltage state signal, the first clock generation control signal is supplied to the clock generator based on the normal voltage state signal, and the second time point precedes the first time point.

9. The liquid crystal display of claim 5, wherein the first clock generation control signal is an enable signal, the second clock generation control signal is a gate clock signal, and the third clock generation control signal is a time delay signal.

10. The liquid crystal display of claim 5, wherein the second clock signal has a inverse phase of the first clock signal.

* * * * *